US005913800A

United States Patent [19]

Williams

[11] Patent Number: 5,913,800

[45] Date of Patent: Jun. 22, 1999

[54] RUBBER COATED ROWEL

[76] Inventor: Gerald Leon Williams, 3449 80th Ave., Olympia, Wash. 98501

[21] Appl. No.: 08/779,215

[22] Filed: Jan. 6, 1997

[51] Int. Cl.[6] ..... A43C 17/00

[52] U.S. Cl. ..... 54/83.1

[58] Field of Search ..... 54/83.1, 83.2

[56] References Cited

U.S. PATENT DOCUMENTS

| | | | |
|---|---|---|---|
| 218,705 | 8/1879 | Buermann | 54/83.1 |
| 769,743 | 9/1904 | Hanaway . | |
| 1,397,966 | 11/1921 | Kelly . | |
| 2,028,674 | 1/1936 | Larson | 119/851 |
| 2,438,978 | 4/1948 | Rosen | 54/83.1 X |
| 2,484,898 | 10/1949 | MacDonald | 54/83.1 X |
| 2,487,461 | 11/1949 | McKinney | 54/83.1 |
| 3,157,013 | 11/1964 | Hayward et al. | 54/83.1 |
| 3,953,958 | 5/1976 | Beaston . | |
| 5,394,677 | 3/1995 | Van Scoyk | 54/83.1 |

FOREIGN PATENT DOCUMENTS 2 257 887 1/1993 United Kingdom .

*Primary Examiner*—Robert P. Swiatek
*Attorney, Agent, or Firm*—Brian J. Coyne

[57] ABSTRACT

A rowel for use on a spur during horseback and bull riding. A rubber composition coating is applied to a rigid metal blank comprising a central portion having a screw hole and integral, circumferentially-spaced, radiating arms. The blank is tapered radially outward from a first, maximum thickness at the central portion, to a second, minimum thickness at an outer edge of each arm, such that the thickness of the improved, rubber coated rowel is everywhere uniform. Versions of the improved rowel for saddleback riding and for bull riding have longitudinal serrations in the rubber coating surface. The improved rowel eliminates the risk of lacerating the hide of a horse or bull, especially when ridden in rodeo competition, and reduces the risk of other kinds of rowel-induced injury to the animal.

5 Claims, 3 Drawing Sheets

RUBBER COATED ROWEL

BACKGROUND OF THE INVENTION

1. Field of the Invention.

The present invention relates generally to the field of spurs for horseback and bull riders. More specifically, the present invention discloses a rubber coated rowel that, when mounted on a spur, will not lacerate or injure the hide of a horse or bull.

2. Background Art.

Spurs, attached to the footwear of a rider, have long been used to goad horses and bulls. A spur has commonly included a U-shaped portion that fits around the heel of a riding boot, held on by straps across the top and bottom of the instep, a rearwardly extending, bifurcated shank, and a rowel pivotably mounted on a pin or screw spanning the aperture between the bifurcations of the shank. The rowel has been generally made of rigid metal, and has included a plurality of circumferentially-spaced, radial arms extending from a central, bored portion. While a horse or bull was being ridden, particularly when attempting to throw a rider in a rodeo, the arms of the rowel would scrape against the hide of the animal, sometimes causing lacerations and bleeding. Such injuries have occasioned protests to rodeo competitions by "animal rights" advocates. For the comfort and health of the animals themselves, as well as for the continued viability of rodeo competitions, it is desirable to use rowels in spurs that do not lacerate or otherwise injure the animals.

McKinney, U.S. Pat. No. 2,487,461, disclosed an ornamental resilient spur suitable for use on a dance floor, made entirely from soft flexible material such as rubber or a suitable plastic composition, one version of which included a soft rubber rowel. McDonald, U.S. Pat. No. 2,484,898, disclosed a toy spur, for use by boys playing cowboy, having a U-shaped body of pliable rubber-like material and an imitation rowel pivotally-mounted at the rear thereof also of rubber-like material. The rowels disclosed in these patents, being made entirely of soft flexible material, lacked adequate rigidity to be adapted for use in riding a horse or bull.

There remains, therefore, a need for an improved rowel that will not lacerate a horse or bull, and that is less likely to otherwise injure the animal—e.g., by bruising.

SUMMARY OF THE INVENTION

The present invention provides an improved rowel formed by cutting a rowel-shaped base from rigid metal and then coating substantially the entire surface of the base with a rubber composition. For use in saddle bronc riding, the radial arms of the improved rowel are each provided with convexly curved shoulders. In the bareback riding version of the improved rowel, the entire periphery of the rowel has longitudinal serrations. In the bull riding version of the improved rowel, each of the radial arms has a pair of adjacent, convex protuberances, and the entire periphery of the rowel likewise has longitudinal serrations. In each version, spurring the animal forces a resilient, rubber composition surface of a rowel into contact with the hide of the animal, instead of rigid metal, thereby lessening the chances of injury to the animal.

DETAILED DESCRIPTION OF THE PREFERRED EMBODIMENT OF THE INVENTION

Figure 1:
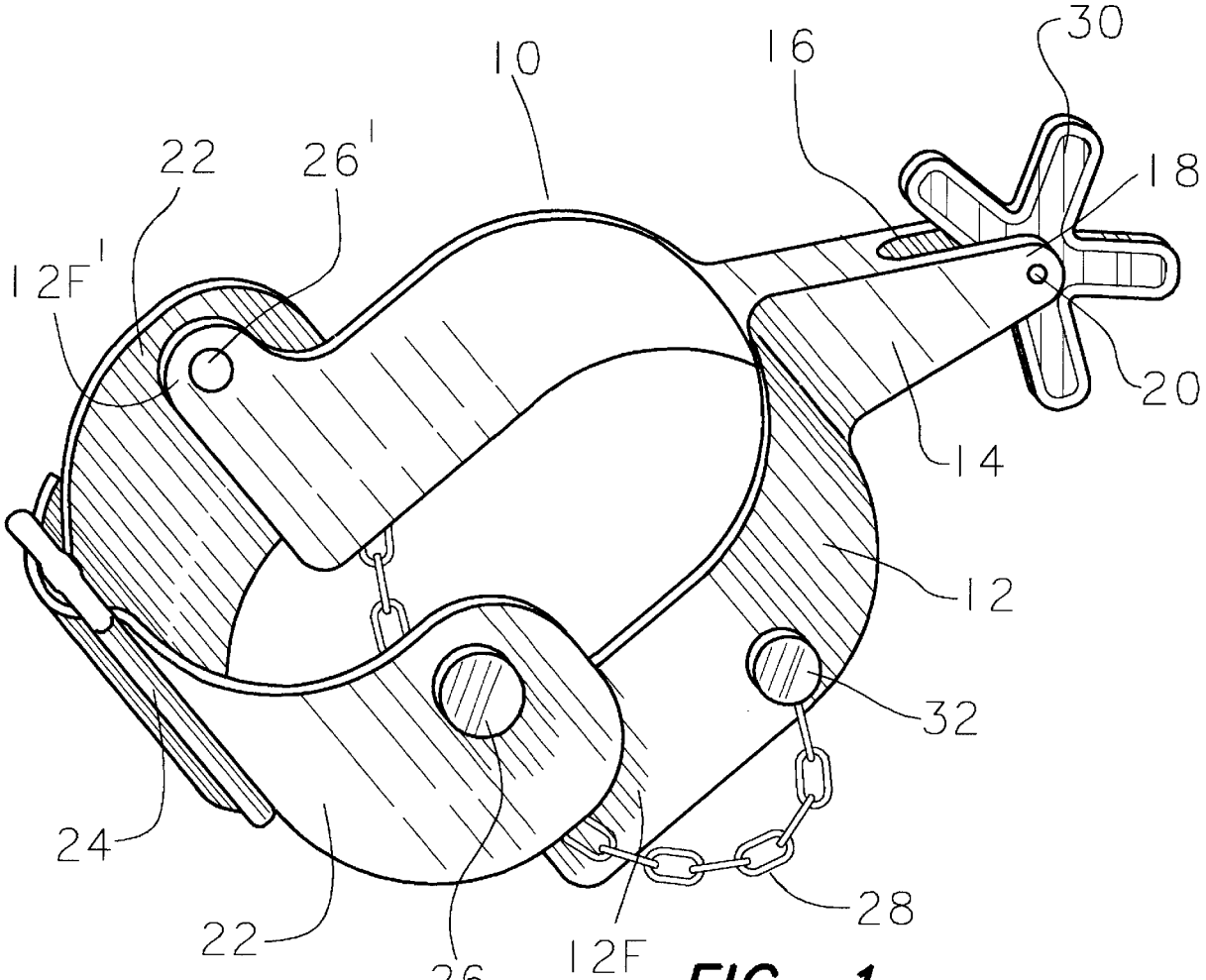
FIG. 1 (Prior Art)
FIG. 1 is a perspective view of a spur having a rowel pivotally mounted, prior art rowel for saddle bronc riding.

Referring to FIG. 1, a spur, generally denoted by the numeral 10, is shown having a U-shaped bight portion 12 and an integral, rearwardly projecting shank 14. The shank 14 is bifurcated by a longitudinal aperture 16 that extends forwardly from a free end 18 thereof. A rowel 30 of the type, prior to my invention, that has been used in spurs when saddleback riding, is shown pivotally mounted to the free end 18 within recess 16 by screw 20, which screw 20 spans recess 16. A pair of leather straps 22, 22', equipped with a buckle fastener 24, are attached to opposite, forward ends 12F, 12F' of bight portion 12 by buttons 26, 26', respectively. A twisted wire brace 28 has opposite ends attached by buttons 32 to opposite sides of bight portion 12. When the spur 10 is attached to a riding boot (not shown), the bight portion 12 engages rear and side surfaces, and the brace 28 engages a front surface, of the heel of the boot. The straps 22, 22' extend up and over an upper arch portion of the boot to secure the spur 10 thereto.

Figure 2:
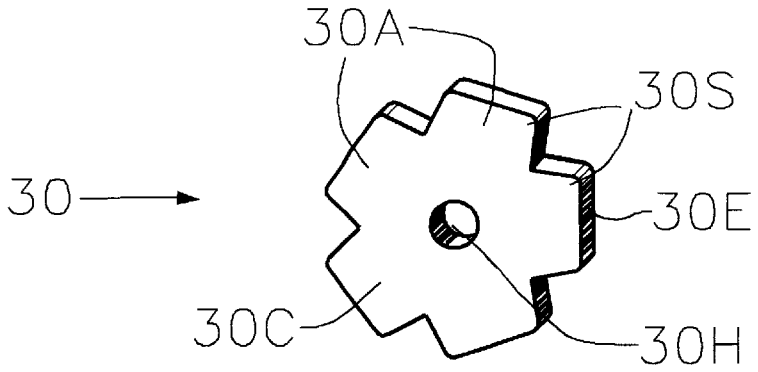
FIG. 2 (Prior Art)
FIG. 2 is an enlarged perspective view of the same rowel.

The same prior art rowel, denoted generally by the numeral 30 and shown in enlarged perspective view in FIG. 2, comprises a central portion 30C integral with five, circumferentially-spaced radial arms 30A, all formed from rigid metal of one-eighth inch uniform thickness. A hole 30H is bored through central portion 30C to receive screw 20. The outer edge surface 30E of each arm 30 is nearly flat but, nevertheless, slightly rounded. Opposite side surfaces 30S of each arm 30A are canted inward in the outward radial direction.

Figure 3:
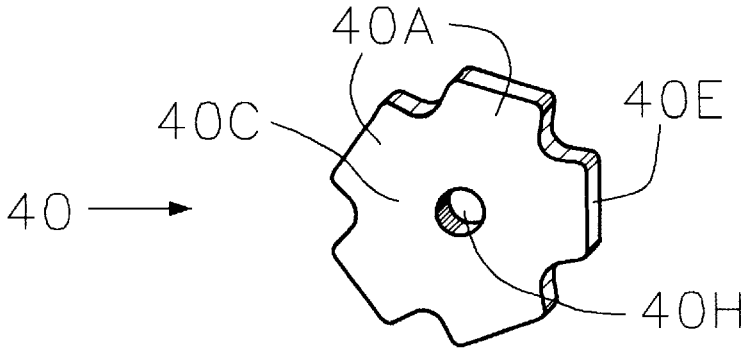
FIG. 3 (Prior Art)
FIG. 3 is a perspective view of prior art rowel for bareback riding.

FIG. 3 depicts in enlarged perspective view a prior art rowel for bareback horse riding, denoted generally by the numeral 40 having a central portion 40C integral with five circumferentially-spaced radial arms 40A, and centrally-located screw hole 40H. Compared to prior art rowel 30, the outer edge surface 40E is flatter and the shoulders 40X are more angular and less rounded.

Figure 4:
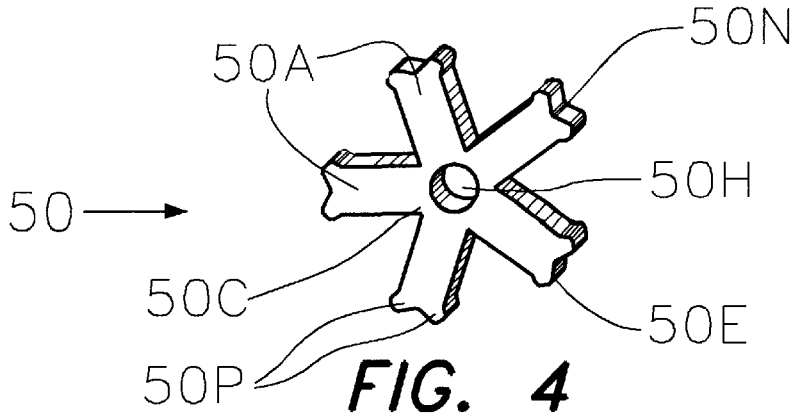
FIG. 4 (Prior Art)
FIG. 4 is a perspective view of a prior art rowel for bull riding.

FIG. 4 is an enlarged perspective view of a prior art rowel for bull riding, denoted generally by the numeral 50, having a central portion 50C integral with five circumferentially-spaced radial arms 50A, and centrally-located screw hole 50H. Compared to the other prior art rowels, 30 and 40, the arms 50A are significantly extended in a radial direction. The outer edge surface 50E of each arm 50A has a longitudinal notch 50N and an adjacent pair of radially convex protuberances 50P disposed on opposite sides of the notch 50N.

Figure 5:
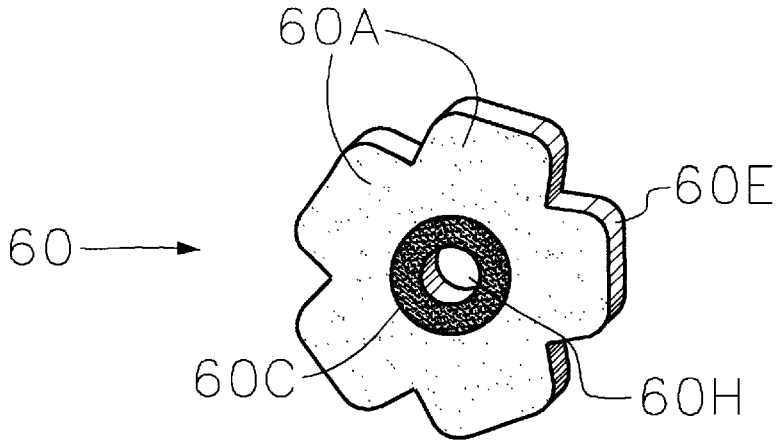
FIG. 5 is a version of an improved rowel for saddle bronc riding.

FIG. 5 is an enlarged perspective view of a preferred embodiment of a version of the improved rowel for use in saddleback riding, denoted generally by the numeral 60. The rowel 60 comprises a central portion 60C integral with five circumferentially-spaced, radial arms 60A. A screw hole 60H is bored through the central portion 60C. The entire surface of the rowel 60, except for the central portion 60C, is covered to an even thickness with a hard rubber composition.

The improved rowel 60 is made by first creating a rigid metal blank (not shown) having shape and size the same as the prior art rowel 30 as depicted in FIG. 2, except that the thickness of the blank is tapered from one-eighth inch (1/8") in the central portion to one-sixteenth inch (1/16") at the outer edge surfaces 60E. Thereafter, a rubber composition is applied to all surfaces of the rowel 60, except the center portion 60C, for example by injection molding, such that the rubber coated rowel 60 will be uniformly one-eighth inch wide from central portion 60C out to the outer edge surfaces 60E. Preferably, the rowel 60 has width from one outer edge surface 60E to an opposite outer edge surface 60E of five-eighths inch (5/8"), and one-eighth inch (1/8") diameter screw hole.

Figure 6:
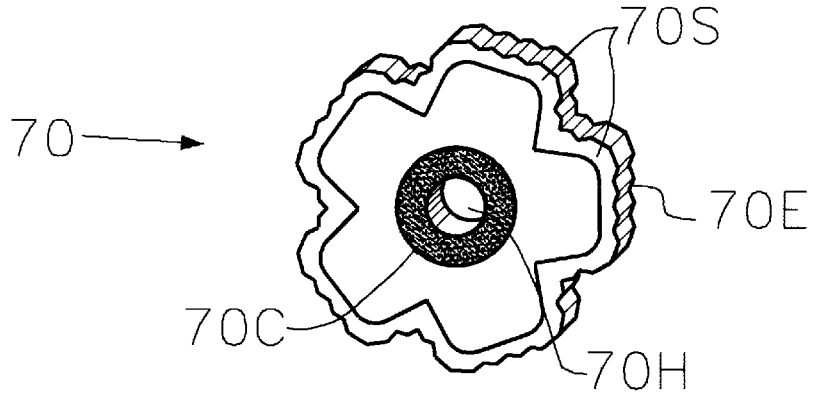
FIG. 6 is a version of an improved rowel for bareback riding.

FIG. 6 is an enlarged perspective view of a preferred embodiment of a version of the improved rowel for use in bareback riding, denoted generally by the numeral 70. The rowel 70 comprises a central portion 70C integral with five circumferentially-spaced, radial arms 70A. A screw hole 70H is bored through the central portion 70C. The entire surface of the rowel 70, except for the central portion 70C, is covered to an even thickness with a hard rubber composition. The rowel 70 is made from a rigid metal blank (not shown) having form and dimensions the same as the prior art rowel 40 as depicted in FIG. 3, except that the blank is tapered from thirteen-sixteenths inch (13/16") thickness at the central portion 70C to one-sixteenth inch (1/16") thickness at the outer edge surfaces 70E. A rubber composition is applied to the entire surface of rowel 70, except for the central portion 70C, such that the rubber coated rowel 70 tapers from thirteen-sixteenths inch (13/16") thick in the central portion 70C to one-eighth inch (1/8") thick at the outer edge surfaces 70E. The entire peripheral edge surfaces 70E, 70S of the rowel 70, moreover, has longitudinal serrations in the rubber coating to increase the friction generated when the rowel 70 contacts the hide of a horse being ridden bareback. Preferably, the rowel 70 has one and one-sixteenth inch (1 1/16") width from an edge surface 70E to an opposite edge surface 70E, and screw hole diameter one-eighth inch (1/8").

Figure 7:
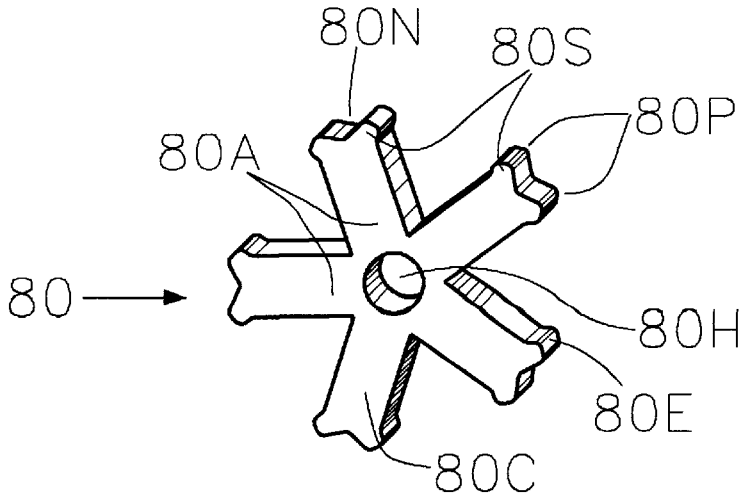
FIG. 7 is a version of an improved rowel for bull riding.

FIG. 7 depicts a preferred embodiment of a version of the improved rowel 80 for bull riding. The rowel 80 is made from a rigid metal blank having form and dimensions the same as the prior art rowel 50 for bull riding depicted in FIG. 4, having a central portion 80C integral with five circumferentially-spaced radial arms 80A, and centrally-located screw hole 80H, except that the blank tapers from one-eighth inch (1/8") at the central portion 80C to one-sixteenth inch (1/16") at the outer edge surfaces 80E. Compared to the other prior art rowels, 30 and 40, the arms 80A are significantly extended in a radial direction. The outer edge surface 80E of each arm 80A has a longitudinal notch 80N and an adjacent pair of radially convex protuberances 80P disposed on opposite sides of the notch 50N. A rubber composition is applied to the entire surface of the rowel 80, except the central portion 80C, so that the rubber coated rowel 80 has a uniform one-eighth inch (1/8") thickness. The entire peripheral surface, including the side walls 80S of the arms 80A, and the outer edge surfaces 80E, has longitudinal serrations. Preferably, the rowel 80 has width one and fifteen-sixteenths inch (1 15/16") from outer edge surface 80E to opposite outer edge surface 80E, and screw hole diameter one-eight inch (1/8").

It will be appreciated that various modifications can be made to the exact form of the present invention without departing from the scope thereof. For example, an improved rowel according to the invention could have four or six arms instead of five arms; each arm could have a rectangular instead of trapezoidal cross-section; the rubber composition coating could include color pigments to enhance the appearance of the rowel; et cetera. Moreover, my invention includes rubber coated rowels wherein the rowels are of the type commonly used in training and riding horses in various equestrian events and competitions other than rodeo competitions, such as polo games, "hunter-jumper," and "cutting and pinning" competitions. It is accordingly intended that the disclosure be taken as illustrative only and not limiting in scope, and that the scope of the invention be defined by the following claims.

I claim:

1. A method for making an improved rowel, comprising the steps of:

forming from rigid metal a rowel blank having a central portion and integral therewith a plurality of circumferentially-spaced, radially extending arms;

boring a screw hole through the central portion;

tapering the thickness of the blank from a first, maximum thickness at the central portion, radially outward along the arms to a second, minimum thickness;

applying a rubber composition coating to the blank such that the thickness of the rubber composition coated rowel is everywhere uniform, and all surfaces of the blank are covered by the rubber composition coat except the central portion.

2. The method of claim 1 wherein the rubber composition coating is applied to the blank by injection molding.

3. The method of claim 1, wherein the rowel is for use in saddle bronc riding, and the blank has five arms, each arm is trapezoidal in transverse cross-section and provided with convexly curved shoulders.

4. The method of claim 1, wherein the rowel is for use in bareback riding, the blank has five arms, each arm is trapezoidal in transverse cross-section, provided with convexly curved shoulders, and comprising the additional step of longitudinally serrating the peripheral surfaces of the arms.

5. The method of claim 1, wherein the rowel is for use in bull riding, each arm of the blank is trapezoidal in transverse cross-section, having a pair of adjacent, radially convex protuberances at a free end thereof, and comprising the additional step of longitudinally serrating the peripheral surfaces of the arms.

* * * * *